US007661682B2

(12) United States Patent
Jenkins

(10) Patent No.: US 7,661,682 B2
(45) Date of Patent: Feb. 16, 2010

(54) RECREATIONAL AND SPORTING DEVICE FOR MOVEMENT OVER GROUND

(75) Inventor: Michael Eric Jenkins, Richmond (AU)

(73) Assignee: Wheelskates Inc., South Australia (AU)

( * ) Notice: Subject to any disclaimer, the term of this patent is extended or adjusted under 35 U.S.C. 154(b) by 467 days.

(21) Appl. No.: 11/436,858

(22) Filed: May 19, 2006

(65) Prior Publication Data

US 2006/0273531 A1 Dec. 7, 2006

(30) Foreign Application Priority Data

May 24, 2005 (AU) ..... 2005902648

(51) Int. Cl.
*A63C 17/04* (2006.01)
*A63C 17/06* (2006.01)
*A63C 17/08* (2006.01)

(52) U.S. Cl. ..... 280/11.212; 280/11.14; 280/602; 280/607; 280/DIG. 13

(58) Field of Classification Search ..... 280/DIG. 13, 280/602, 11.14, 607, 11.212
See application file for complete search history.

(56) References Cited

U.S. PATENT DOCUMENTS

| | | | | | |
|---|---|---|---|---|---|
| 2,520,793 | A | * | 8/1950 | Blackwell | 280/11.24 |
| 2,675,243 | A | * | 4/1954 | King | 280/11.24 |
| 2,931,012 | A | | 3/1960 | Kosach | |
| 4,363,493 | A | | 12/1982 | Veneklasen | |
| 4,709,491 | A | * | 12/1987 | Morell et al. | 36/118.4 |
| 5,106,110 | A | | 4/1992 | Williamson | |
| 5,251,934 | A | * | 10/1993 | Gates | 280/842 |
| 5,487,522 | A | * | 1/1996 | Hook | 248/549 |
| 5,487,552 | A | * | 1/1996 | Daoust | 280/11.214 |

FOREIGN PATENT DOCUMENTS

| | | | | |
|---|---|---|---|---|
| BE | 621598 | | | 12/1962 |
| DE | 156048 | A | | 11/1904 |
| DE | 4301101 | | | 7/1994 |
| DE | 4440945 | | | 5/1996 |
| FR | 551033 | | | 3/1923 |
| FR | 907544 | A | | 3/1946 |
| FR | 2454317 | A | | 9/1980 |
| FR | 2497460 | A | | 6/1982 |
| FR | 2497460 | A | * | 7/1982 |
| SU | 1639686 | A1 | | 4/1991 |
| WO | WO96/04967 | A1 | | 2/1996 |

* cited by examiner

*Primary Examiner*—Lesley Morris
*Assistant Examiner*—Bryan A Evans
(74) *Attorney, Agent, or Firm*—Defillo & Associates, Inc.; Evelyn A. Defillo

(57) ABSTRACT

The present invention relates to a recreational and sporting device (10) comprising a foot support (12) that is mounted on a first wheel (26) such that the foot support is located below the axis of rotation of a first wheel (26). The foot cradle (12) is hingedly attached to a leg support (18) which is adapted to be attached to a user's leg. The device (10) may further include a second wheel (56) used for stabilization and to assist in steering. The device (10) provides a recreational and sporting apparatus that is more manoeuvrable and can be used on uneven terrain where conventional skates, such as in-line skates, cannot be used.

21 Claims, 8 Drawing Sheets

RECREATIONAL AND SPORTING DEVICE FOR MOVEMENT OVER GROUND

CROSS-REFERENCE TO RELATED APPLICATIONS

This application claims the benefit of Australian Patent Application No. AU 2005902648, filed May 24, 2005. The entire disclosure of this prior application is hereby incorporated by reference.

STATEMENT REGARDING FEDERALLY SPONSORED RESEARCH OR DEVELOPMENT

This invention has been created without the sponsorship or funding of any federally sponsored research or development program.

SEQUENCE LISTING OR PROGRAM

Not applicable.

BACKGROUND OF THE INVENTION

The present invention relates generally to recreational and sporting devices and more particularly to recreational and sporting devices of the type including a foot support mounted to a wheel where a person stands in a generally upright position and travels over the ground.

Recreational and sporting devices comprising a foot support mounted to one or more wheels, where a person stands in a generally upright position and travels over a surface, are well known in the art. One such type of device is the skateboard, which is constructed for use on paved or other kinds of finished surfaces. Other such devices include either the conventional or in-line roller skates having a plurality of wheels for use on similar types of finished surfaces.

In all of the above-described devices, both steering and braking is only achieved by shifting the weight of the rider, which means that unless the person is highly skilled their control of the device, especially braking control, is at times questionable. Further because by virtue of their design they have relatively small diameter wheels the devices are limited to use on relatively smooth finish surfaces and are not appropriate for rough and uneven terrain. The smaller wheels also lead to high wear and tear of the device, and the speed of the user is limited. Conventional and in-line skates also have the disadvantage that since there are typically four wheels on the ground at any one time, this limits manoeuvrability of the device which means that the turning circle for such devices is quite large.

The need exists for a wheeled type recreational and sporting device where a person stands and which can be used in travelling on rougher ground than is allowed by the use of current devices.

It is an object of this invention to provide a new and improved type of recreational and sporting device that overcomes at least some of the above-mentioned problems or provides the public with a useful alternative.

The above and other objects are achieved according to this invention by providing a device comprising a foot support that is mounted on a wheel such that the foot support is located below the axis of rotation of the wheel.

SUMMARY OF THE INVENTION

Therefore in one form of the invention there is proposed a recreational and sporting device including:

a first wheel having an axle;

a foot cradle rotatably attached to the axle of the first wheel, wherein the foot cradle is located substantially below the axis of rotation of the first wheel; and a leg plate hingedly attached to the foot cradle and adapted to be attached to a lower leg of a user.

Preferably the device includes a biased member attached between the foot cradle and leg plate, wherein the biased member is adapted to support the user's foot and leg. The biased member is rotatably attached to the foot cradle and wheel axle and further pivotably attached to an upper end of the leg plate. The biased member includes a biasing spring.

Preferably the recreational and sporting device includes a second wheel. The second wheel is configured to pivot around a vertical axis in relation to the axle of the first wheel. The second wheel is of a smaller diameter than the first wheel. The second wheel is rigidly attached to the foot cradle.

Preferably the device further includes a braking mechanism. The braking mechanism is actuated by the user's hands by means of a lever.

Preferably the first wheel comprises a hub, rim and tyre. An inner portion of the first wheel is curved outwardly between the hub and the rim. Typically the tyre is a pneumatic tyre.

Preferably the braking mechanism is attached to the first wheel and located adjacent to the hub.

Preferably an outer edge of the foot cradle lies within the vertical footprint of the first wheel.

Preferably the braking mechanism includes a first and second arm which are biased and configured to engage a ring shaped braking surface. The first and second arm pincerably engage the ring shaped braking surface upon actuation of the braking mechanism by the user.

Preferably the foot cradle and leg support are constructed from a composite material such as but not limited to fibreglass composite or carbon fibre composite. Alternatively, the foot cradle and leg support are constructed from metal or plastic.

In a further form of the invention there is proposed a method of transporting a user over terrain using a recreational and sporting device having:

a first wheel having an axle;

a foot cradle rotatably attached to the axle of the first wheel, wherein the foot cradle it located substantially below the axis of rotation of the first wheel;

a leg plate hingedly attached to the cradle and adapted to be attached to a lower leg of a user;

wherein a single device is attached to each leg of a user and used to propel the user across the terrain. It is to be understood that this action may be a skating or skiing action.

Preferably each device is configured to correspond to either the left leg or the right leg, wherein the opposing first wheels are positioned adjacent to the outer surface of each of the user's legs.

Preferably each device includes a biased member attached between the foot cradle and leg plate, wherein the biased member is adapted to support the user's foot and leg.

Preferably each device includes a braking mechanism to assist the user in terminating movement of the first wheel or to assist in steering.

BRIEF DESCRIPTION OF THE DRAWINGS

The accompanying drawings, which are incorporated in and constitute a part of this specification, illustrate several implementations of the invention and, together with the description, serve to explain the advantages and principles of the invention.

In the drawings.

DETAILED DESCRIPTION OF PREFERRED EMBODIMENTS

Figure 1:
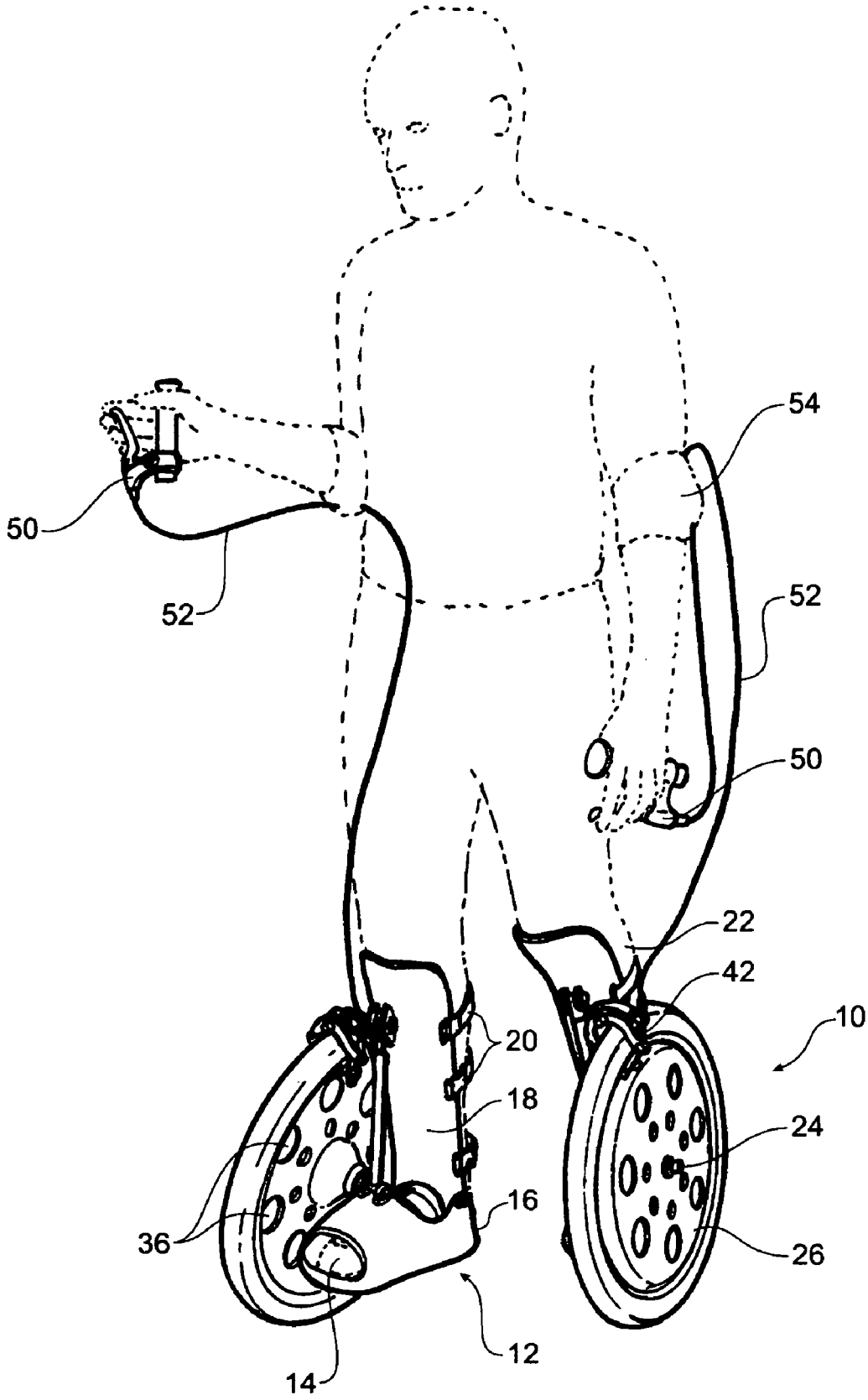
FIG. 1 is a perspective view of a person using a first embodiment of a recreational device.
Figure 2:
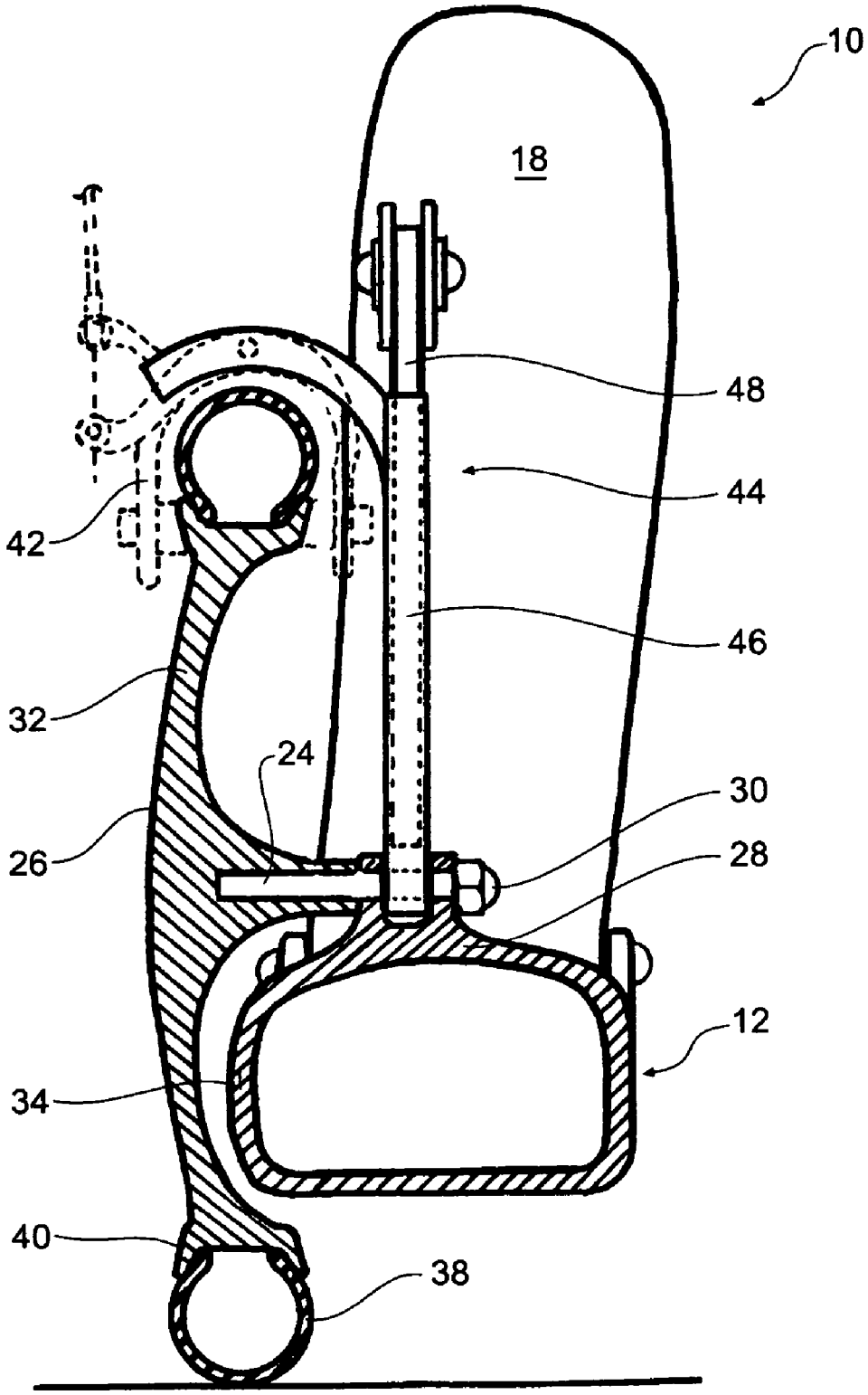
FIG. 2 is a cross-sectional view of the device illustrated in FIG. 1 in this case the device corresponding to the right leg of the user.

The following detailed description of the invention refers to the accompany drawings. Although the description includes exemplary embodiments, other embodiments are possible, and changes may be made to the embodiments described without departing form the spirit and scope of the invention. Wherever possible, the same reference numbers will be used throughout the drawings and the following description to refer to the same and like parts.

Referring now to the drawings there is shown a recreational and sporting device 10 constructed according to the teachings of the present invention and identified generally by reference numerals. Device 10 includes a rigid foot cradle 12 adapted to accommodate a person's foot and formed of an integral shell having a toe and a rear opening 14 and 16. Hinged to the cradle 12 is a leg support plate 18 including a plurality of straps 20 of an adjustable type lock arrangement and adapted to engage the lower portion of a user's leg 22. The cradle 12 is designed to accommodate not only the foot of the user but a standard shoe, such as a sports shoe. However, that is not to say that the cradle 12 may in fact include an inner portion that accommodates a portion of the user's leg, much alike a ski boot.

The leg plate 18 provides support for the leg and has distinct advantages over the prior art. The combination of a foot cradle 12 and leg guard 18 provides greater protection for the user, in that they are less likely to twist or break their ankle during use because the device extends over the lower part of the leg and knee of the user. This is in contrast with conventional or in-line skates which barely extend over the ankle of the user. The leg plate 18 may also be configured to extend over the knee of the user thereby providing an inbuilt knee protector.

The foot cradle 12 is rotatably journalled through axle 24 of wheel 26 at the upper surface 28 of the cradle 12 so that when the user has mounted the device 10 the foot lies below the axle 24. The foot cradle 12 is secured there by a typical nut arrangement 30. The wheel 26 is a standard configuration wheel but with the exception that the central portion 32 of the wheel 26 is of a concave arrangement so that some of the outer side 34 of cradle 12 lies within the vertical footprint of the wheel 26. To provide the greatest manoeuvrability the ball of the user's foot is located directly below the axle 24. It is however envisaged that this may not always be necessary, for instance if the device 10 was configured for speed the axle 24 may be located in front of the ball of the user's foot.

The wheel 26 may typically be a solid composite construction, such as fibreglass composite or carbon fibre composite, having a plurality of holes 36 that add to the visual appeal and lighten the structure whilst retaining the structural integrity of the wheel. The wheel 26 further includes a tyre tube 38 as is well known in the art, whilst the outer perimeter of the wheel 26 includes a rim 40 adapted to act as a braking surface for a braking arrangement 42, such as a disc type system illustrated in FIG. 1 which is well known for use on bicycles.

It is to be understood that the journaling of the rotational attachment of the various parts is achieved by standard well known engineering techniques and it is not intended to discuss these in further detail.

The leg support plate 18 is hinged to cradle 12 to allow for the users foot to freely rotate around an axis parallel to the axis of rotation of wheel 26. Extending between the upper end of the leg plate 18 and the axle 24 is a biased support member 44 consisting of an outer member 46 attached to the axle 24 and slidably supporting an inner member 48 that at one end is rotatably attached adjacent to the upper end of the leg plate 18. The biased member 44 provides support for the user's foot, such that the user's shin muscles do not become strained during use. Any biasing means could be used, such as a spring, provided it is responsive to the movement of the user and does not unduly restrict the movement of the user's leg during use of the device 10.

The reader should appreciate that the biased member 44 is used to compensate for the weight of the foot cradle 12 and wheel 26. The weight of the device would tend to pull the end of the user's foot down. Therefore, the biased support 44 facilitates use of the device without risking strain. It should however be appreciated that the device 10 could work without the use of a biased member 44, such as when a user becomes proficient. Alternatively, the biased member 44 could be located at the point where the foot cradle 12 and leg plate 18 pivot.

Figure 3:
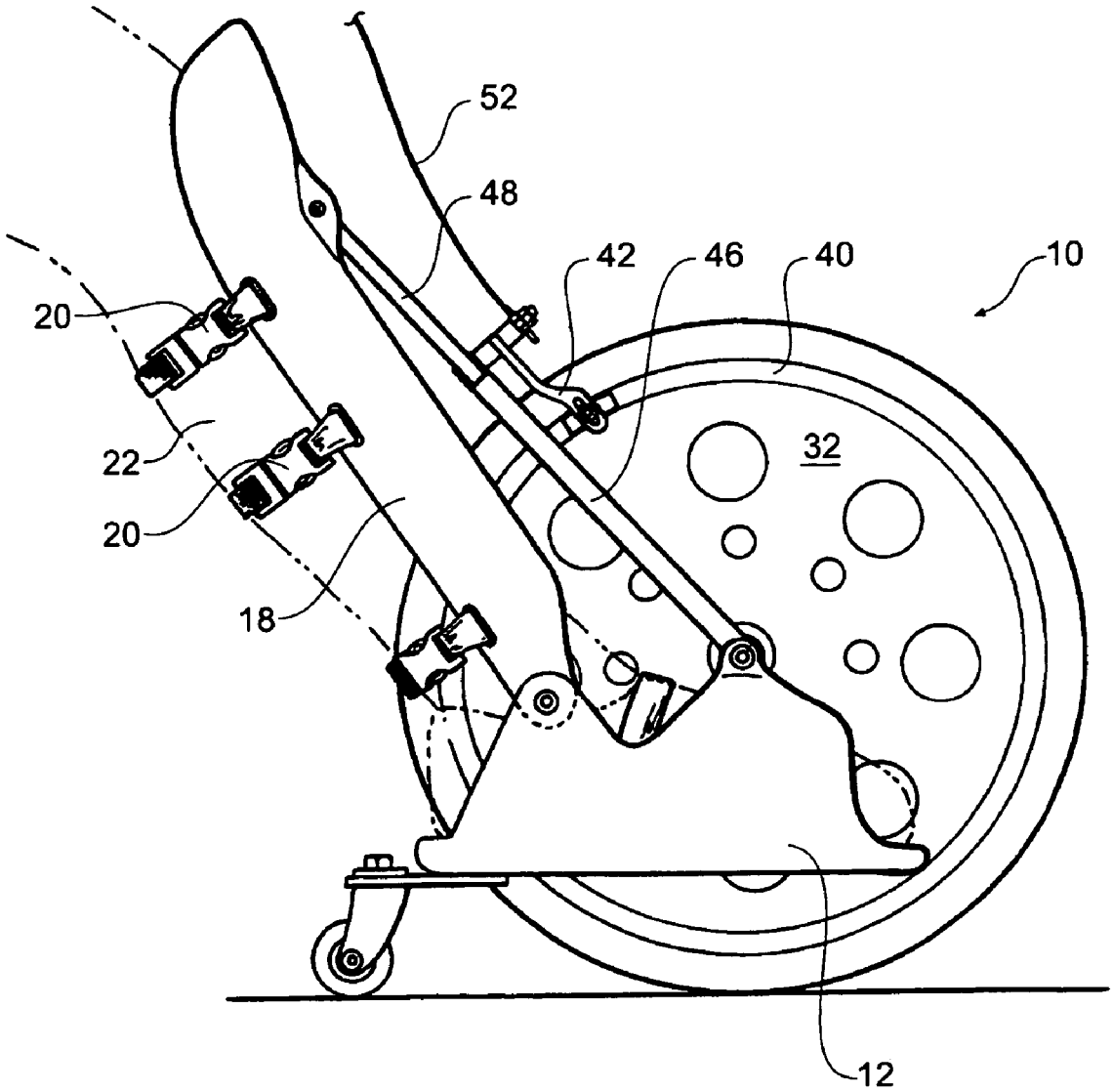
FIG. 3 is a side view of the device of FIG. 1 used by the left leg of a user and when in a first travelling position.
Figure 4:
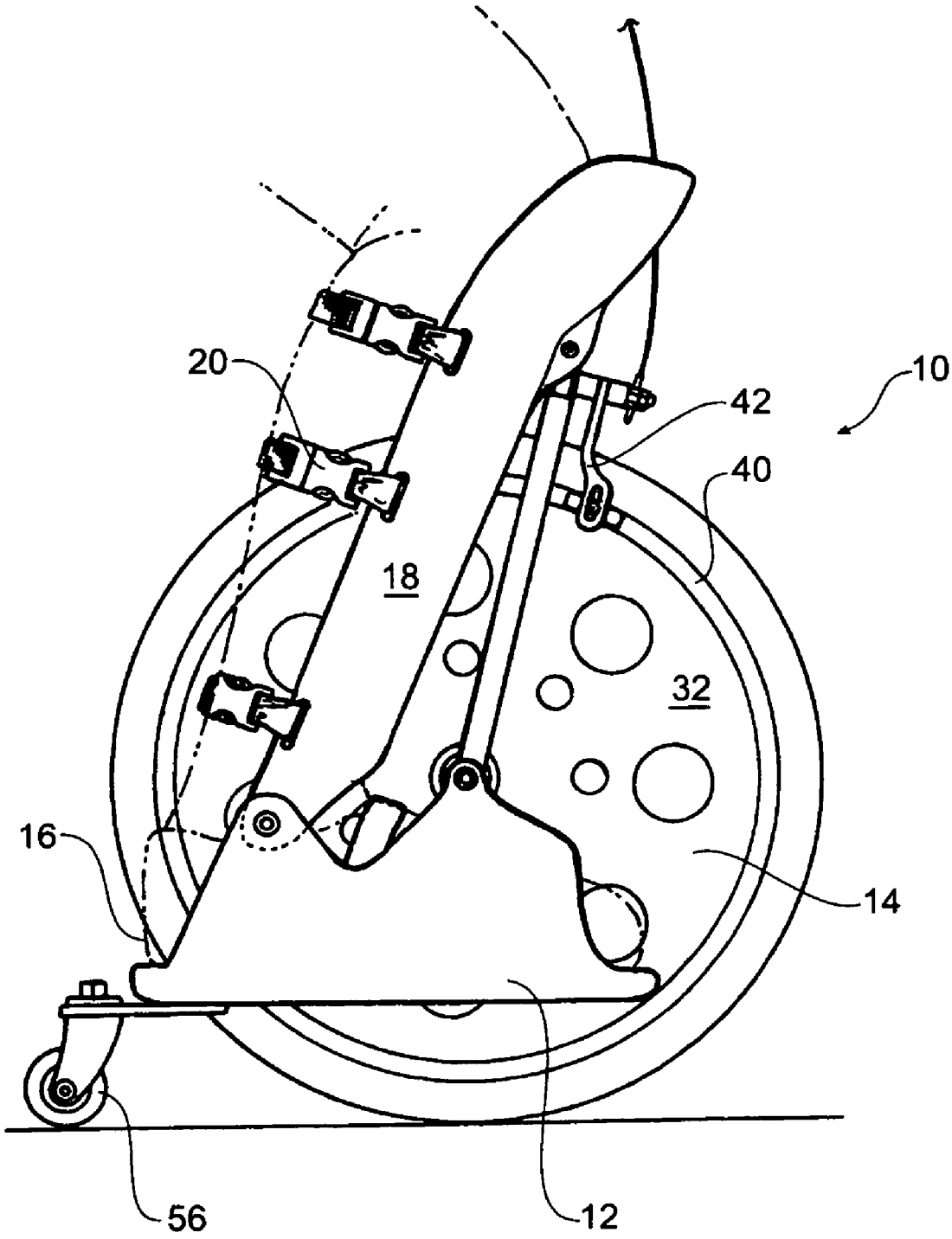
FIG. 4 is a side view of the device of FIG. 3 in a second travelling position.

Since the leg plate 18 is rotatably fixed to the cradle and to the axle 24 the reader will appreciate why the member 44 needs to have a sliding arrangement. As best illustrated in FIG. 3, when the user has mounted the apparatus and is leaning backwards or has extended their foot during use, the biased member 44 is in an extended state. However, when the user leans forward so that the lower leg leans forward over the foot as in FIG. 4, the biased member 44 needs to be in retracted position. Thus biased member 44 provides support for the user's leg thereby minimising the strain on the user's leg muscles.

Although not illustrated, between the inner and outer members 48 and 46 there may be located a stop to minimise any sudden impact or jarring when the biased member 44 rapidly moves to the retracted position as may occur when the user is in an aggressive travelling or "skating' mode.

The biased member 44 or more specifically the upper end of the outer member 46 is also used to support, in a fixed position, the braking mechanism 42 so that it is always next to the braking surface 40. Other than stated above, the braking system is of the form typically employed on bicycles and is activated by a squeezable handle 50, one for each wheel, through cable 52. The handle 50 is held by the user during use. To ensure the cable 52 does not get tangled up with the wheel 26 or passing objects, such as trees, the user may feed them through elbow guards 54. The cable 52 may also be clipped to a user's belt or other items of clothing.

Although not considered to be an essential feature the apparatus 10 may include an additional wheel 56 mounted to the rear of the foot cradle 12. This wheel 56 may act in several different capacities. It may be used as a trainer wheel for new or cautious users and it also assists during intense braking action much like a stabiliser wheel. The wheel 56 also prevents the user from falling backwards which could cause significant injury. The wheel 56 has a swivel action which provides for greater cornering and turning ability.

Although it is envisaged that the wheel 56 will be attached to the cradle 12 in a rigid manner, the wheel 56 may also be mounted to the cradle through a flexible member such as fibreglass coated plywood that also provides a damping effect which, in combination with the pneumatic tyre, provides a softer ride. The invention is however not limited to the use of the additional wheel 56. An expert may not require the rear wheel 56 for stabilisation and therefore the rear wheel 56 could be removably attached to the foot cradle 12 so that when a user become proficient in using the device the wheel 56 could be completely removed, much like training wheels on a bicycle can be removed.

The cradle 12 is configured so that the user can leave their own conventional shoes on during use. This means that wherever the user is they are able to dismount from the device 10 and are still wearing protective footwear. This would be useful if a user was travelling from point A to point B, such as going to work or the shops, as they would be wearing footwear when they dismount the device 10. Typically, the device 10 will be constructed in a series of different sizes to fit a range of shoe sizes, each having wheel 26 of different diameters. It is envisaged that there will be three different sized wheels 26 used, such as 24 inch, 22 inch and 20 inch diameter.

Figure 5:
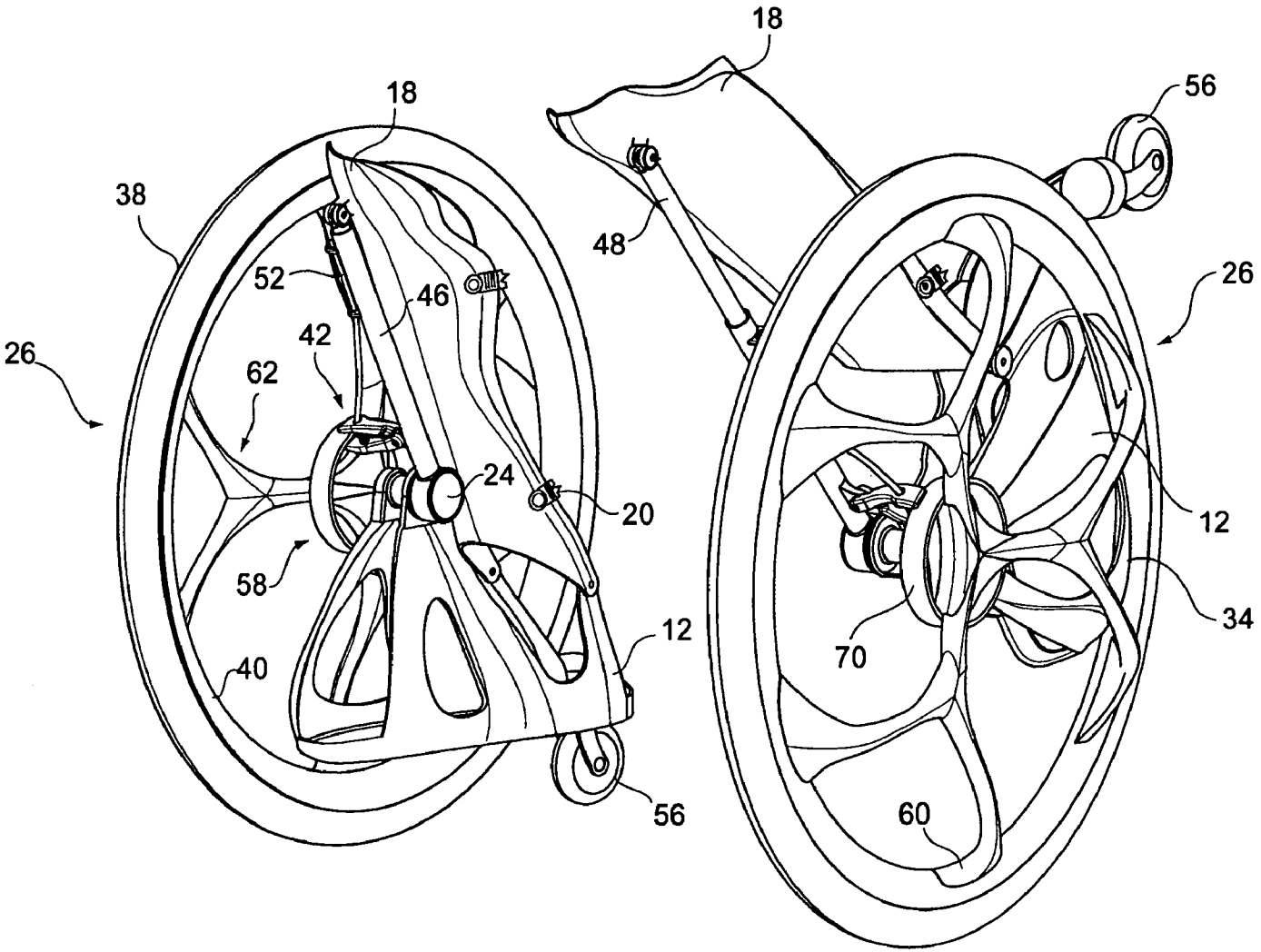
FIG. 5 is a perspective view of a second embodiment of the recreational device.

In an alternate embodiment as illustrated in FIG. 5, the braking arrangement 42 is located at the hub 58 of wheel 26 proximal to the axle 24. In this way the tyre 38 can be removed without having to disengage the braking arrangement 42. The wheel 26 includes curved spokes 60 which have a concave shaped inner surface 62 such that the outer side 34 of cradle 12 lies within the vertical footprint of the wheel 26.

Figure 6:
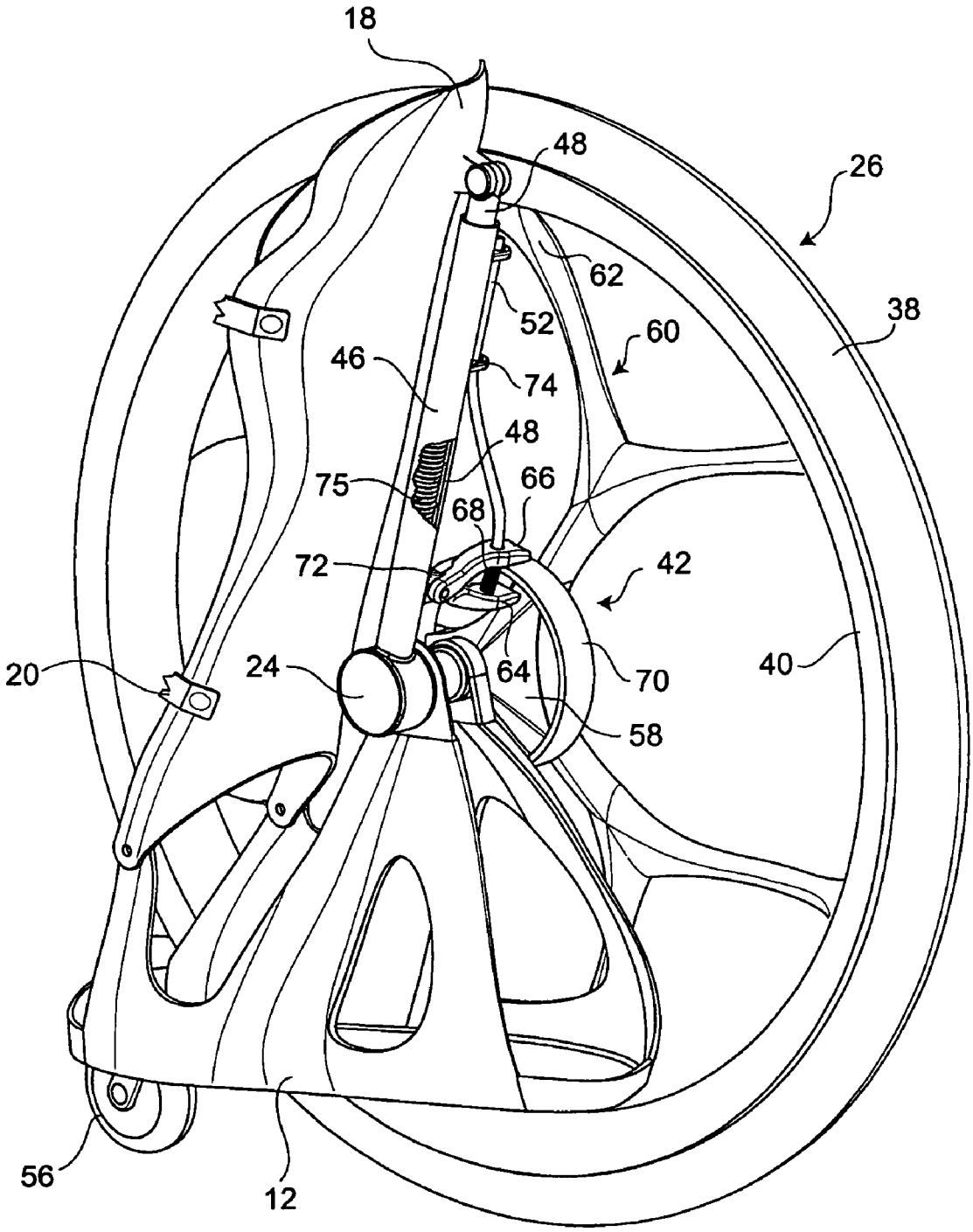
FIG. 6 is a perspective view of the wheel hub of the recreational device of FIG. 5.

The braking arrangement 42 of the alternate embodiment is further illustrated in FIG. 6 and includes first and second biased arms 64 and 66 and a biasing spring 68 which are engaged therethrough by cable 52. The braking member 42 further includes a ring shaped braking surface 70 which is mounted to the hub 58 of wheel 26. The first and second arms 64 and 66 are mounted onto bracket 72 which extends outwardly from the member 46. The first and second arms 64 and 66 are configured to engage the braking surface 70 upon actuation of the squeezable handle 50. The member 46 also includes cable eyelets 74 which ensure that the cable 52 does not rub against or become tangled up with the wheel 26 during use. There may also be eyelets located on respective knee portions of the leg plates 18 (not shown). These eyelets would be of a larger size to allow for the free movement of the cable 52 therethrough as the user extends his or her leg during use. As further illustrated in FIG. 6, the biasing member 44 includes a spring 75 connected between inner and outer members 46 and 48 thereby providing support for the user's leg during use. The spring 75 is housed within inner tube 48.

Figure 7:
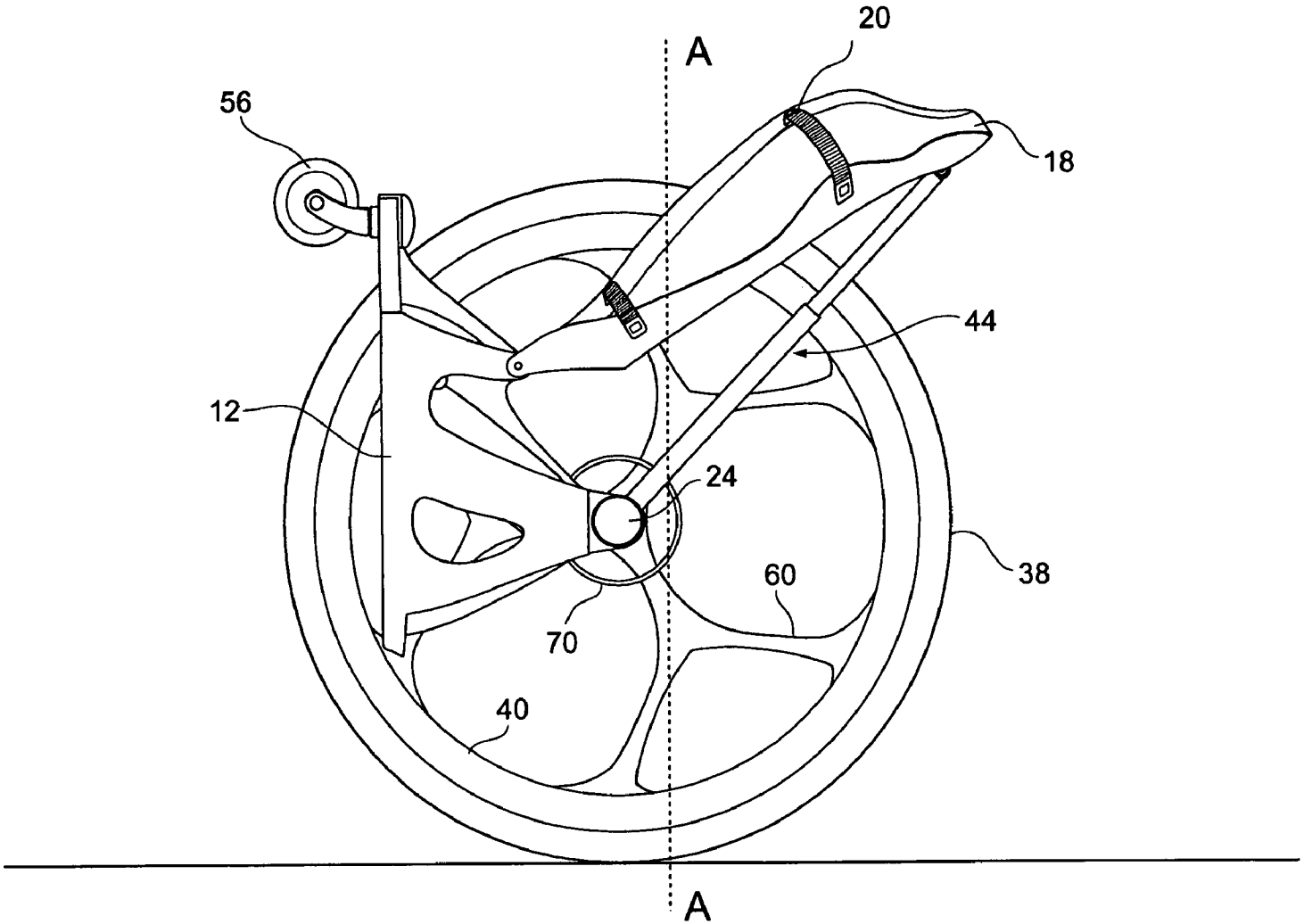
FIG. 7 is a side view of the recreational device of FIG. 5.

As illustrated in FIG. 7, during use the rear wheel 56 may not be in contact with the ground at all times. This would occur when the user is aggressively skating at high speed or as they push off when they begin to skate. In both instances the foot is extended rearward of the user's body. As further illustrated in FIG. 7, the leg support 18 extends around the outer portion of the user's leg thereby protecting the leg 22 or clothing from coming into contact with the rotating wheel 26 during use.

Figure 8:
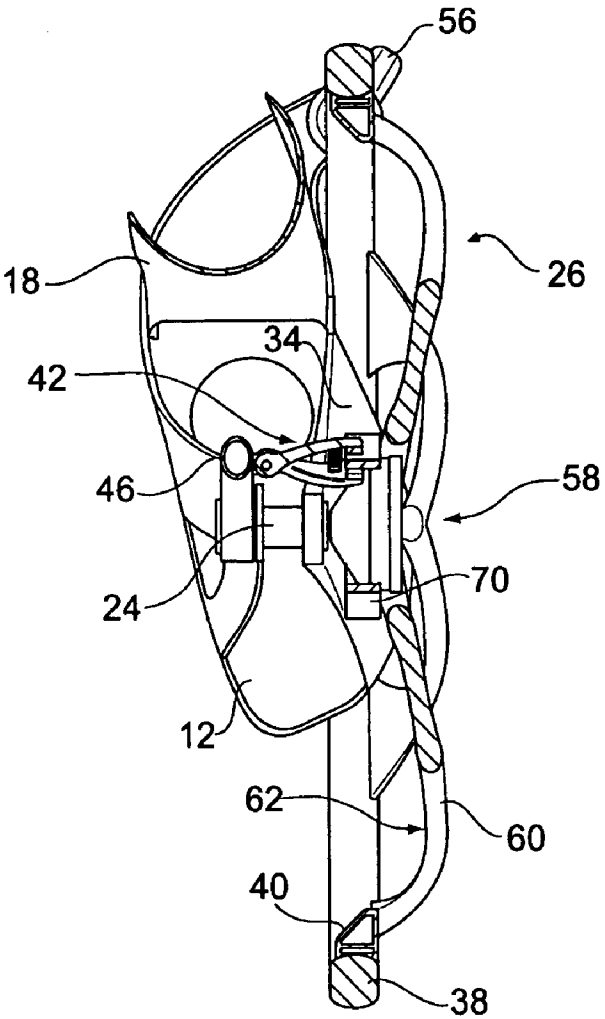
FIG. 8 is a cross-sectional view through M of the recreational device of FIG. 7.

The cross-sectional view in FIG. 8 illustrates the curved spokes 60 with a concave shaped inner surface 62 which extend between the hub 58 and rim 40. As illustrated, this enables the outer side 34 of cradle 12 to lie within the vertical footprint of the wheel 26 which assists in providing greater stability to the device 10 during use.

The device 10 may be constructed from typical materials such as, metal, fibreglass composite or carbon fibre composite. Obviously the device 10 for each leg will be a mirror image of each other and a right leg device may not be mounted on the left leg and vice versa. However, the wheels may be adapted for quick coupling and decoupling from the cradle and the brake mechanism and there is no reason why these devices would not be stored in an easily assembled and disassembled state.

When using the present invention the rider mounts both devices and pushes himself or herself off much like skating. However, the wheels, being of a large diameter, are able to accommodate rough and uneven ground much easier than the wheels of conventional roller skate or in-line skates device. It should be appreciated that to enable free movement of the user's leg and foot, the axes of rotation, between the leg support 18 and the cradle 12, where the support member 44 connects to the leg support 18, and where the support member 44 connects to the cradle 12, are all parallel. Furthermore, the support member 44 is perpendicular to these axes of rotation.

As the skilled addressee will appreciate the use of a single large wheel 26 provides greater manoeuvrability than conventional skates as there is only one point of contact with the ground upon which the user pivots. This is in contrast with conventional or in-line skates which typically have at least four wheels in contact with the ground. The present invention therefore provides a recreational device which has a smaller turning circle.

Slowing down the device 10 is achieved by simply activating the brake handles 50 the amount of braking proportional to the squeezing of the handles. To turn the rider simply shifts their weight and controls the steering by turning their legs. The wheels, being firmly fixed to the cradle, then turn in the direction pointed by the rider.

The user may also use the brakes to assist in steering, for instance the user could apply the brake corresponding to their left foot to turn their direction of travel to the left. Alternatively, the right brake could be applied to move to the right. Since there is only one wheel in contact with the ground and therefore only one pivot point for each foot the user has the ability to turn sharply. It is therefore possible for the user to skate in a manner similar to the slalom action in snow skiing to thereby slow down.

The skilled addressee will now appreciated the many advantages of the present invention. The device 10 provides a recreational and sporting apparatus that can be used on uneven terrain and in places where conventional skates, such as in-line skates, cannot be used. The use of a large wheel also may mean that the user can traverse over smooth surfaces at greater speed and with less effort than when using conventional skates. By being able to use their own shoes the user has the advantage of have shoes on when they reach their destination or if they want to dismount the device for some other reason. This is particularly useful if the user is going down to the shops or going to work where skates cannot be worn. The addition of rear support wheels and brakes makes the device safe for use even by inexperienced users, while the different sizes make it suitable for both young people and adults alike.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A recreational and sporting device including:

a first wheel having an axle;

a foot cradle rotatably attached to the axle of the first wheel, wherein the foot cradle is located below the axis of rotation of the first wheel;

a leg support plate hinge mounted to the foot cradle, wherein the leg support plate is an elongated plate that continuously extends through the length of the lower leg of the user, wherein a biased member provides support to the user's lower leg; and a biased member extending between the upper end of the leg support plate and the axle of the wheel, the biased member comprising an outer member and an inner member, wherein the inner member slides inside the outer member;

wherein the outer member is rotatably attached to the pivot point where the upper end of the foot cradle and the first wheel axle meet and wherein the inner member is attached to the upper end of the leg support plate or;

wherein the outer member is attached to the upper end of the leg support plate and wherein inner member is rotatably attached to the pivot point where the upper end of the foot cradle and the first wheel axle meet.

2. A recreational and sporting device comprising:

a first wheel having an axle;

a foot cradle rotatably attached to the axle of the first wheel, wherein the foot cradle comprises an outer side, an inner side, an upper end, a bottom end, a front end, and a rear end; wherein the foot cradle is located below the axis of rotation of the first wheel, wherein the foot cradle and the axle meet at a pivot point;

a leg support plate hinge-mounted to the foot cradle, wherein the leg support plate is an elongated plate that continuously extends through the length of the lower leg of the user, wherein the leg support plate includes an upper end and a bottom end, wherein the bottom end is hinged to the upper end of the foot cradle and the upper end is placed near the knee of the user; and a biased member extending between the upper end of the leg support plate and the axle of the first wheel, wherein the biased member comprises an outer member and an inner member, wherein the inner member slides inside the outer member;

wherein the outer member is rotatably attached to the pivot point where the upper end of the foot cradle and the first wheel axle meet and wherein the inner member is pivotably attach to the upper end of the leg plate or;

wherein the outer member is attached to the upper end of the leg support plate and wherein inner member is rotatably attached to the pivot point where the upper end of the foot cradle and the first wheel axle meet.

3. The device according to claim 2, wherein the biased member includes a biased spring.

4. The device according to claim 2, wherein the device further includes a second wheel mounted to the rear end of the foot cradle.

5. The device according to claim 4, wherein the second wheel is configured to pivot around a vertical axis in relation to the axle of the first wheel.

6. The device according to claim 4, wherein the second wheel is of a smaller diameter than the first wheel.

7. The device according to claim 4, wherein the second wheel is rigidly attached to the foot cradle.

8. The device according to claim 2, further including a braking mechanism.

9. The device according to claim 8, wherein the braking mechanism is actuated by the user's hands by means of a lever.

10. The device according to claim 2, wherein the first wheel comprises a hub, rim and tire.

11. The device according to claim 2, wherein an inner portion of the first wheel is curved outwardly between the hub and the rim.

12. The device according to claim 10, wherein the tire is a pneumatic tire.

13. The device according to claim 8, wherein the braking mechanism is attached to the first wheel and located adjacent to the hub.

14. The device according to claim 2, wherein an outer edge of the foot cradle lies within a vertical footprint of the first wheel.

15. The device according to claim 8, wherein the braking mechanism includes a first and second arm, which are biased and configured to engage a ring-shaped braking surface.

16. The device according to claim 15, wherein the first and second arm pincerably engage the ring-shaped braking surface upon actuation of the braking mechanism by the user.

17. The device according to claim 2, wherein the foot cradle and leg support are constructed from a composite material chosen from fiber glass composite or carbon fiber composite.

18. The device according to claim 2, wherein the foot cradle and leg support are constructed from metal.

19. The device according to claim 2, wherein the foot cradle and leg support are constructed from plastic.

20. A recreational and sporting device comprising:

a wheel having an axle;

a foot cradle rotatably attached to the axle of the wheel, wherein the foot cradle comprises an upper end and a bottom end, wherein the foot cradle is located below the axis of rotation of the wheel;

a leg support plate hinge-mounted to the foot cradle, wherein the leg support plate is an elongated plate that continuously extends through the length of the lower leg of the user, wherein the leg support plate includes an upper end and a bottom end, wherein the bottom end is hinged to the upper end of the foot cradle and the upper end is placed near the knee of the user;

a biased member extending between the upper end of the leg support plate and the axle of the wheel, the biased member comprising an outer member and an inner member, wherein the inner member slides inside the outer member;

wherein the outer member is rotatably attached to the pivot point where the upper end of the foot cradle and the first wheel axle meet and wherein the inner member is attached to the upper end of the leg support plate or;

wherein the outer member is attached to the upper end of the leg support plate and wherein inner member is rotatably attached to the pivot point where the upper end of the foot cradle and the first wheel axle meet.

21. The device according to claim 2, wherein the first wheel further comprises concave-shaped inner surfaces and wherein a portion of the outer side of the foot cradle lies in the concave-shaped inner surfaces of the first wheel.

* * * * *